United States Patent [19]

Gorsky et al.

[11] 4,262,576

[45] Apr. 21, 1981

[54] PERCUSSION INSTRUMENT STRIKING APPARATUS

[76] Inventors: Egon Gorsky; William A. Gorsky, both of 306 W. Dudley Ave., Westfield, N.J. 07090

[21] Appl. No.: 76,398

[22] Filed: Sep. 17, 1979

[51] Int. Cl.[3] ..... G10D 13/00

[52] U.S. Cl. ..... 84/422 R

[58] Field of Search ..... 84/422 R

[56] References Cited

U.S. PATENT DOCUMENTS

| | | | |
|---|---|---|---|
| 1,508,390 | 9/1924 | Gladstone et al. | 84/422 R |
| 2,484,302 | 10/1949 | Laverents | 84/422 R |
| 2,484,936 | 10/1949 | Dezso | 84/422 R |
| 3,618,441 | 11/1971 | Fearns | 84/422 R |
| 3,988,957 | 11/1976 | Escamilla | 84/422 R |
| 4,048,896 | 9/1977 | Calato et al. | 84/422 R |
| 4,134,325 | 1/1979 | Loftus | 84/422 R |

FOREIGN PATENT DOCUMENTS

| | | | |
|---|---|---|---|
| 2061077 | 6/1972 | Fed. Rep. of Germany | 84/422 R |

*Primary Examiner*—L. T. Hix
*Assistant Examiner*—Alan Mathews
*Attorney, Agent, or Firm*—Watson, Leavenworth, Kelton & Taggart

[57] ABSTRACT

A foot-operable striking apparatus for actuating a beater to strike a percussion instrument. The apparatus includes a pivotally mounted pedal having a toe-retaining clip overlying its toe portion. The pedal is pivotally mounted at its heel portion, so that it can be moved upwardly and downwardly by an ankle-flexing motion of the operator's foot. Linkage means are provided which will move a beater used with the apparatus into striking position when the pedal is elevated or depressed. The linkage means are arranged to provide a natural feel so the apparatus can be readily operated to produce a series of beats of equal amplitude, and so the apparatus can be operated at a high speed.

8 Claims, 5 Drawing Figures

PERCUSSION INSTRUMENT STRIKING APPARATUS

BACKGROUND OF THE INVENTION

This invention relates to the musical instrument art, and more particularly relates to a striking apparatus for a percussion instrument which is adapted to be operated by the foot of the musician and which is especially suitable for producing rapid sequences of beats.

As is well known to those skilled in the art, a variety of foot-actuated devices can be utilized to strike a percussion instrument such as a drum. For example, a common type of foot actuated striker includes a base, a beater hub pivotally mounted to the forward end of the base, and a pedal pivotally mounted at its heel end to the rearward end of the base. A spring is provided for urging the beater hub towards a retracted position. A flexible strap is wrapped partially around the beater hub and extends to the toe end of the pedal. In use, the stem of a mallet-like beater is affixed to the beater hub and the apparatus is placed in front of a drum.

Thus, when the operator depresses the pedal, the toe end of the pedal pulls on the strap and rotates the beater hub to move the beater forward into striking engagement with the drum and produce a beat. When the operator raises his foot, the spring restores the beater hub to its retracted position, thus wrapping the strap back onto the beater hub and raising the pedal, so that the apparatus is ready to be actuated again.

As will be readily appreciated, such apparatus requires a complete up and down motion of the foot to produce each beat; the upstroke of the foot does not produce a beat, but merely allows the spring to reset the apparatus. Also, the speed of operation of the apparatus is limited by the speed with which the spring will restore the beater to its retracted position. If, immediately after a first beat, the musician attempts to produce a second beat before the apparatus is fully reset, the strap will become slack and the beater will only swing through part of its arc on the second beat. Therefore, the second beat will be far weaker than the first beat. Both of these factors make it difficult to produce a rapid sequence of beats by the use of such apparatus, and therefore make such apparatus unsuitable for playing extremely fast rhythms.

Various modified striker assemblies have been proposed to obviate the speed limitations of the conventional striker assembly described above. For example, as shown in U.S. Pat. No. 3,618,441, issued Nov. 9, 1971 to J. A. Fearns, the conventional striker assembly described above is modified by providing a pedal which is pivotally mounted to the base at its center, so that the pivot lies between the heel portion of the pedal and the toe portion of the pedel. With this arrangement, the operator can rock the pedal about the pivot by alternately depressing the heel portion and the toe portion of the pedal to move the toe portion of the pedal up and down. The beater hub and strap are arranged so that either downward or upward motion of the toe porition of the pedal will pull the strap and rotate the beater hub and beater into striking position. Thus, the operator can produce a series of beats by a heel and toe action.

A variant of such apparatus is set forth in U.S. Pat. No. 1,508,390, issued Sept. 16, 1924 to W. D. Gladstone et al. In this variant, a system of rigid links is used instead of a flexible strap to link the toe portion of the pedal to the beater hub. However, the basic motion is the same as that of the apparatus taught by Fearns: the pedal is pivoted between its heel and toe portions, so that the operator may produce a series of beats by alternately depressing the heel portion and the toe portion of the pedal.

Mechanisms which incorporate such heel and toe actuation would theoretically be more suited to rapid operation than the conventional striker apparatus first described above, because only one stroke of the operator's foot is required to produce each beat. However, the heel and toe rocking motion requires the operator to pivot his foot about the center of his sole, and to move his entire foreleg up and down in a somewhat unnatural and fatiguing manner. Such motion is more difficult to accomplish than the simple ankle flexing motion required to actuate the conventional apparatus described above. Therefore, the heel-and-toe actuated apparatus described above has never achieved widespread acceptance by musicians.

SUMMARY OF THE INVENTION

It is an object of the present invention to provide a striking apparatus which can be utilized with a beater and a percussion instrument to produce a rapid number of controlled beats in response to a natural, motion of the operator's foot in which the operator simply pivots his foot about his ankle.

It is a further object of the present invention to provide such apparatus with a "feel" which makes it easy for the operator to produce a series of beats of equal magnitude as he pivots the toe of his foot upwardly and downwardly, but which also makes it easy for the operator to vary the magnitude of each beat as he operates the apparatus.

Yet another important object of the present invention is to provide a striking apparatus which efficiently utilizes the available range of motion of the human foot about the ankle, so that the amplitude and force of the foot pivoting motions required to produce each beat are well matched to the amplitude and force of natural, unstrained motions of the human foot about the ankle.

The apparatus of the present invention includes a base and a pedal having a toe portion and a heel portion. The heel portion of the pedal is adapted to receive the heel of the operator's foot. The pedal is pivotally mounted at its heel portion to the base for motion about a pedal pivot axis generally perpendicular to the heel to toe axis of the pedal. A clip is affixed to the pedal so that the clip overlies the toe portion of the pedal in spaced relation thereto. Thus, the clip and the toe portion of the pedal cooperatively define a space which is adapted to receive the toe portion of the operator's foot. The operator may move the pedal to a depressed position by pivoting his foot about his ankle to move the toe portion of the pedal downwardly, and the operator may also move the pedal to an elevated position by pivoting his foot about his ankle to move the toe portion of the pedal upwardly.

A beater holder is movably mounted to the base, and a linkage means is provided for moving the beater holder into and out of an active, striking position in response to movement of the pedal. The linkage means is "positive" in the sense that it connects the pedal to the beater holder without any substantial slop and without the use of any element which can become slack. Thus, the position of the beater holder within its range of movement during operation of the apparatus is a function solely of the position of the pedal. The linkage means is arranged so that the beater holder is in its striking position when the pedal is in its depressed position and when the pedal is in its elevated position, but the beater holder is out of its striking position when the pedal is in any position between its elevated and depressed positions.

The apparatus of the present invention is utilized in combination with a beater and a percussion instrument. For such use, the beater is attached to the beater holder and the instrument is juxtaposed with the apparatus so that the beater will be in contact with the instrument when the beater holder is in its striking position. Thus, the operator can beat the instrument with the beater by actuating the pedal. As will be appreciated, the operator can produce a double beat by first depressing the toe of his foot and then elevating it.

In the preferred embodiment of the apparatus, a biasing means for biasing the pedal to a neutral position closer to the elevated position than to the depressed position is provided. When this arrangement is utilized, the upward stroke of the operator's toe required to produce a beat by elevating the pedal will be shorter than the downward stroke required to produce a beat by depressing the pedal. This relationship corresponds to the natural action of the human ankle joint: a normal human being can depress the toe of his foot from its normal position by a greater amount than he can elevate it. Thus, the available range of positions provided by the human ankle joint is efficiently utilized by the apparatus of the present invention.

In the normal mode of use, the operator will produce the first beat of a sequence by depressing the pedal. During the relatively long downward stroke, the operator can impart substantial momentum to the pedal and the beater, to produce a substantial impact on the instrument and provide a beat of satisfactory amplitude. During the upstroke, the biasing means cooperate with the operator's foot to lift the pedal back through this same substantial distance to the neutral position, and this action is assisted by the rebound of the beater from the instrument. Thus, as the pedal reaches the neutral position, the pedal and the operator's foot are already moving with substantial momentum, and the operator need only provide slight, upwardly-directed assistance to continue the upstroke until the pedal reaches the elevated position and another beat is produced.

These and other objects, features and advantages of the present invention will be more readily apparent from the detailed description of the preferred embodiments set forth below, when read in conjunction with the accompanying drawings, wherein the same reference numerals are used to designate the same features in all views.

DETAILED DESCRIPTION OF THE PREFERRED EMBODIMENTS

Figures 1, 2:
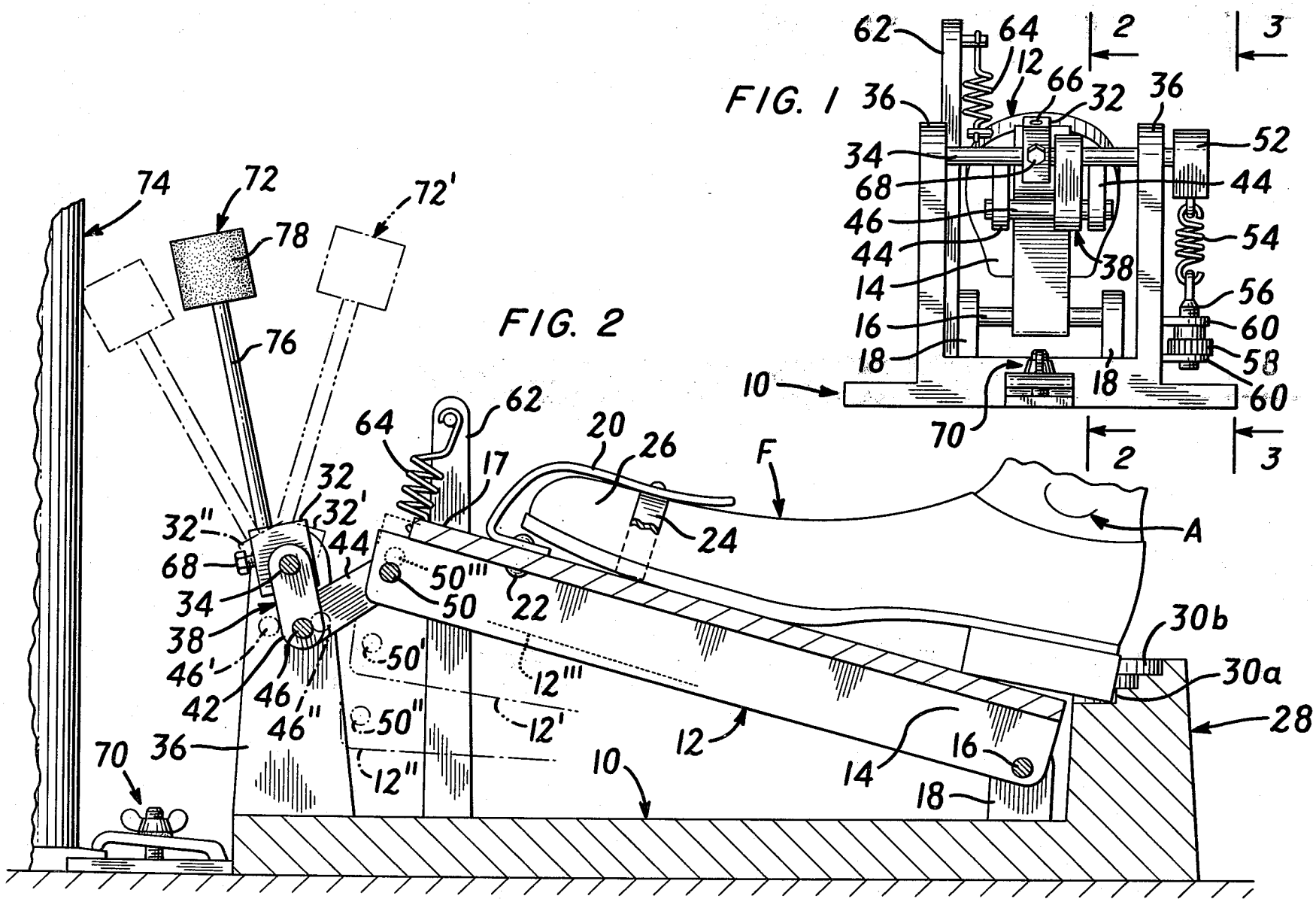
FIG. 1 is an elevational view of apparatus according to a first embodiment of the present invention.
FIG. 2 is a sectional view, taken along line 2—2 in FIG. 1, depicting the apparatus in conjunction with a beater and a drum.

As shown in FIGS. 1 through 4, apparatus according to a first embodiment of the present invention includes a base 10 and a pedal 12. The heel portion 14 of the pedal is pivotally mounted to the rearward portion of the base by means of an axle 16 and upwardly-extending supports 18 which are formed integrally with the base. The axle 16 extends generally horizontally and generally perpendicularly to the axis connecting the heel portion 14 of the pedal and the toe portion 17 of the pedal. A toe clip 20 is affixed to the toe portion 17 of the pedal by means of rivets 22 and a strap 24 (FIG. 2). The toe clip overlies the toe portion of the pedal to define a space 26. Thus, the operator may place his foot F upon the pedal so that the heel of the foot lies on the heel portion 14 of the pedal and the toe of the foot is received in the space 26. In this psition, the ankle joint A of the foot will be adjacent to the axle 16, and thus adjacent to the axis about which the pedal 12 pivots.

Figure 4:
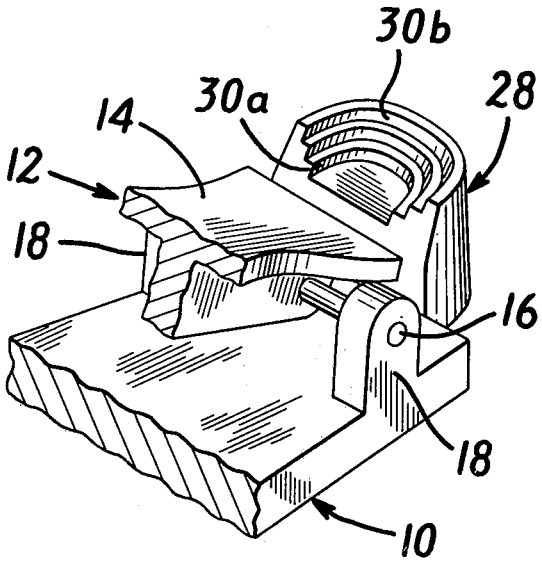
FIG. 4 is a fragmentary perspective view depicting a portion of the apparatus shown in FIG. 1.

To help retain the operator's foot in position on the pedal, a heel abutment 28 is formed integrally with the rearward portion of the base. The heel abutment is provided with a series of small steps 30 to accomodate feet of different sizes. The heel of a relatively small foot will abut the innermost step 30*a*, while the heel of a relatively large foot will abut the outermost step 30*b*. As depicted in FIG. 4, the steps 30 of the heel abutment are also formed to retain the heel against lateral motion.

A beater holder 32 is affixed to a shaft 34 which is rotatably mounted between a pair of supports 36 formed integrally with the base 10 at the forward end thereof. As will be apparent from FIG. 2, the shaft 34 is positioned forwardly of the toe portion 17 of the pedal 12 and is positioned at a greater elevation from the base than the axle 16. The shaft 34 extends parallel to the axle 16.

An arm 38 is affixed to the shaft 34, so that the arm will pivot in unison with the beater holder 32. The arm extends away from the shaft 34 to an end 42 remote from the shaft. A pair of rigid links 44 are pivotally mounted to the end 42 of the arm by means of a pin 46, which extends through the arm and through an arm-engaging end of each link 44. The opposite, pedal-engaging end of each link 44 is pivotally connected to the toe portion 17 of the pedal by means of a pin 50 which extends through the pedal and the links.

A spring arm 52 (FIGS. 1 and 3) is rigidly mounted to the shaft outboard of the supports 36. A tension spring 54 extends from the end of the spring arm remote from the shaft to an adjusting screw 56. The adjusting screw extends to a knurled nut 58 which is retained at a fixed vertical position by a pair of brackets 60. The tension of spring 54 can be adjusted by turning the nut to move the screw upwardly or downwardly, towards or away from the shaft 34.

A spring tower 62 extends upwardly beyond the pedal from the base 10 adjacent to the toe portion 17 of the pedal. A pedal spring 64 is affixed to the upper end of the spring tower and to the toe portion of the pedal so that the pedal spring is in tension and urges the toe portion of the pedal upwardly.

Figure 3:
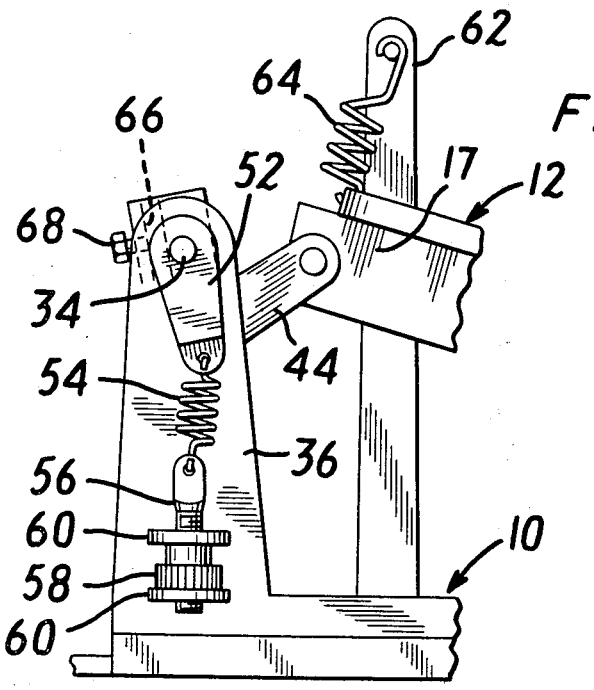
FIG. 3 is a fragmentary elevational view of the apparatus, taken along line 3—3 in FIG. 1.

When the apparatus is in the position illustrated in solid lines in FIG. 2 and illustrated in FIG. 3, the tension spring 54 exerts a downward force on the end of spring arm 52, which tends to rotate the spring arm and the shaft 34 in the clockwise direction, as seen in the figures. This action biases the end 42 of the arm 38 (FIG. 2) downwardly, so that the arm in turn exerts a downward pull on the toe portion of the pedal through the links 44 and the pins 46 and 50. In this position of the mechanism, the tension spring 54 balances the upward pull on the pedal exerted by the pedal spring 64. Thus, the mechanism will return to this position in the absence of external loads, and the springs 54 and 64 cooperatively serve to bias the pedal 12 to the neutral position depicted in solid lines in FIG. 2. In this position, the pedal extends generally upwardly and forwardly from its heel portion to its toe portion. When the pedal is in this position, the beater holder 32 is in its so-called intermediate position, depicted in solid lines in FIG. 2.

The beater holder 32 is provided with a bore 66, best seen in FIGS. 1 and 3, and a setscrew 68 which extends through a threaded hole in the beater holder to the bore 66. A drum-attaching clamp 70 is provided at the forward end of the base 10. This clamp is of a conventional type.

The apparatus described above is to be utilized in conjunction with a conventional, mallet-like drum better 72 and a drum 74, both of which are depicted in FIG. 2. The drum is affixed to the forward end of the base by means of the clamp 70. The stem 76 of the beater 72 is inserted in the bore of the beater holder 32, and the setscrew 68 is tightened so that the beater is affixed to the beater holder.

As set forth above, the springs 54 and 64 bias the mechanism to the position depicted in solid lines in FIG. 2. With the pedal in this neutral position, the foot is in its rest position and extends generally perpendicularly from the operator's foreleg at the ankle joint. To beat the drum 74, the operator first pivots his foot F about his ankle A to force the toe portion 17 of the pedal 12 downwardly. As the toe portion of the pedal moves downwardly, the links 44 force the pin 46 and the end 42 of arm 38 forwardly. This action rotates the shaft 34 and the beater holder 32 in the clockwise direction, as seen in FIG. 2, carrying the head 78 of the beater 72 rearwardly, away from the drum 74. This action continues until the pedal reaches a semi-depressed position, indicated in broken lines at 12'. At such time, the pins 50 and 46 are in the positions indicated in broken lines at 50' and 46' respectively, the beater holder is in its fully-retracted position, indicated at 32', and the beater is retracted away from the drum, as indicated at 72'. Thus, in this position of the mechanism, the links 44 extend generally parallel to the pedal; a straight line drawn through the pins at positions 46' and 50' would pass through the axle 16.

As the toe portion of the pedal is forced further downwarly, past the aforementioned semi-depressed postion, the links 44 pull the end 42 of the arm rearwardly, so that the arm, the shaft 34, the beater holder 32 and the beater 72 pivot counterclockwise. Thus, the beater holder moves past the intermediate position depicted in solid lines in FIG. 2 to the striking position indicated at 32'', and the head of the beater contacts the drum 74 to produce a beat as the pedal reaches the depressed position 12''. When the pedal is in the depressed position 12'', the pinst 46 and 50 are in the positions indicated at 46'' and 50'', respectively. A straight line drawn through these positions would pass through the shaft 34. Thus, the links 44 extend in a common plane with the arm 38 in this position of the mechanism.

At this point, the operator reverses the motion of his foot and the toe portion of the pedal moves upwardly. The pedal passes back through the semi-depressed postion 12' to the neutral position depicted in solid lines. Thus, the beater holder 32 first rotates clockwise through the intermediate position depicted in solid lines in FIG. 2 to the fully retracted position indicated at 32, and then rotates counterclockwise, again reaching the intermediate position as the pedal 12 reaches the neutral position.

As the upstroke continues, the pedal moves toward the elevated position depicted at 12''', lifting the pin 50 along with it to the position indicated at 50''' and thus pulling the links 44 upwardly and rearwardly. This action pulls the end 42 of the arm rearwardly, to that the pin 46 again reaches the position indicated at 46'' and the beater holder rotates counterclockwise to again reach it striking position 32''. Thus, as the pedal reaches the elevated position, the head 78 of the beater 72 impacts on the drum again to produce a second beat.

The operation can be repeated, beginning with another downstroke.

As will be appreciated by reference to FIG. 2, the neutral position of the pedal 12 is closer to the elevated position 12''' than to the depressed position 12''. Thus, the upward motion of the foot from its rest position required to produce a beat on the upstroke is less than the downward motion of the foot from the rest position required to produce a beat on the downstroke. The relatively small upward displacement of the toe from its rest position is desireable. because the human ankle joint has only a relatively limited range of toe-upward flexure. However, the additional motion of the toe on the downstroke is not wasted.

During the entire downstroke of the pedal, the operator's foot, the pedal and the other elements of the mechanism are building momentum, so that, if the pedal is depressed forcefully, the beater head will impact on the drum at a substantial velocity and produce a beat of substantial amplitude at the end of the downstroke.

Also, during the downstroke, the pedal spring 64 is being continually stretched, and energy is being stored in the pedal spring. This energy is returned to the pedal on the upstroke. Thus, the longer the downstroke of the pedal, the greater the energy stored in the pedal spring, and the greater the energy returned to the pedal by the spring during the upstroke. As will be appreciated, such energy must be generated by the operator's foot during the downstroke. However, since the operator is generally able to generate more energy on the downstroke than on the upstroke, such energy storage and return helps to match the available energy during each stroke to the task at hand, and allows the operator to readily produce beats of equal magnitude on the upstroke and downstroke.

Also because of the inequality of downward and upward displacements of the toe from its rest position, the greatest portion of the upstroke occurs while the toe of the foot is below its rest position. During this portion of the upstroke, the operator can impart substantial upward momentum to the pedal by pulling the pedal upwardly with the toe clip. Also, when the pedal reaches the neutral position on the upstroke, the head of the beater is already moving toward the drum. Thus, during the portion of the upstroke between the neutral and elevated positions of the pedal, where the foot is least capable of providing any forceful assistance, the least assistance is needed.

Although operation of the apparatus has been described above in stepwise fashion, these steps occur in a continuous series of connected motions during actual use of the apparatus to produce a series of closely spaced beats. During such operation, the motion of the apparatus is assisted by the rebounding of the beater head from the drum after each beat.

Of course, the apparatus can be operated to produce an individual beat, rather than a continuous series of beats. Such operation may be accomplished by simply executing one downstroke of the pedal in the manner described above, and then stopping the upstroke of the pedal at the neutral position.

Alternatively, a single beat can be produced by executing only an upstroke from a dead start. Normally, a single beat produced in this manner will be weaker than a single beat produced by a downstroke from a dead start.

Upstroke beats from a dead start, downstroke beats from a dead start, and continuous series of upstroke and downstroke beats can be combined in any desired manner. As will be appreciated, the apparatus of the present invention allows the operator to completely control the beating action in any situation. For example, during a series of downstroke beats, the operator can interpose an upstroke beat by simply carrying the pedal motion through to the elevated position on the upstroke, and he can accomplish this without any hesitation or break in the rhythm.

Whether the apparatus is operated to produce a series of beats or to produce an individual beat, the operator can control the amplitude of the sound of each beat by controlling the speed of the pedal. In this regard, the toe clip provides an additional benefit: it is impossible for the toe portion of the pedal to move faster than the toe of the operators foot in either direction.

Figure 5:
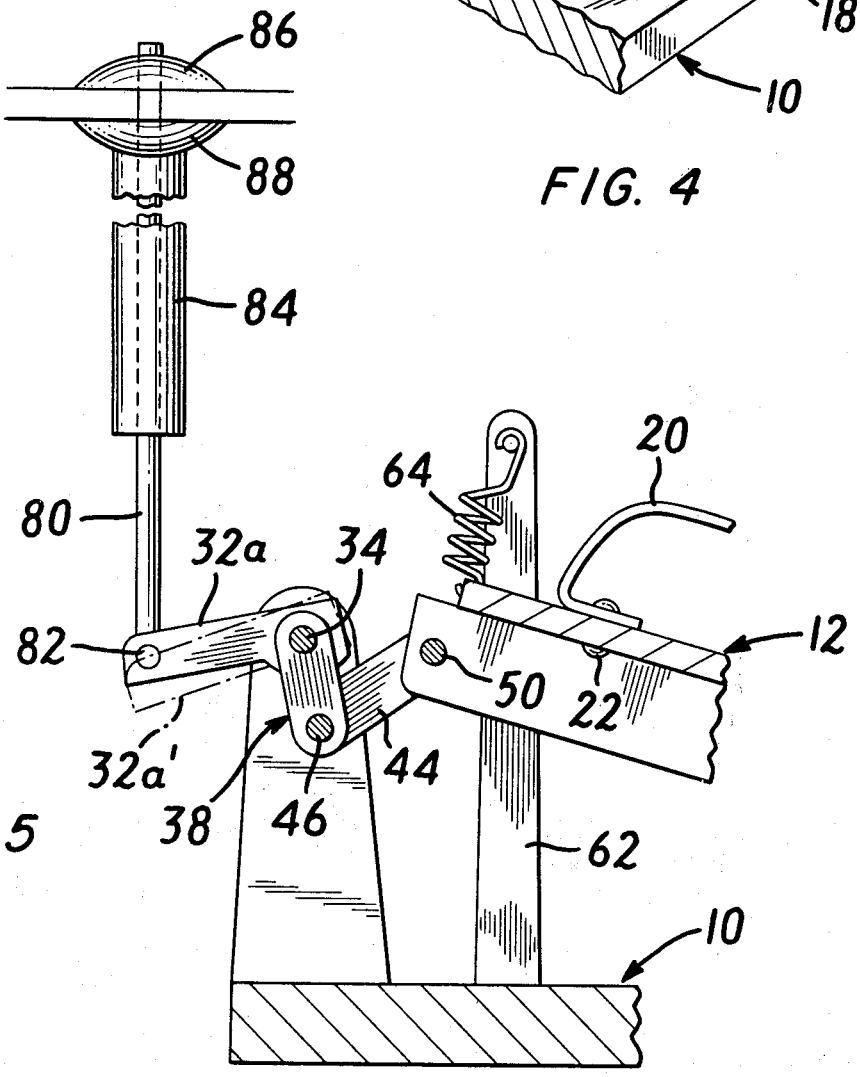
FIG. 5 is a fragmentary elevational view depicting apparatus according to a second embodiment of the present invention in conjunction with a pair of cymbals.

Apparatus according to a second embodiment of the present invention is depicted in FIG. 5. This apparatus is similar to the apparatus described above. However, the beater holder 32*a* of the apparatus depicted in FIG. 5 extends forwardly from the apparatus, and the beater holder is constructed so that the lower end of a rod 80 can be affixed to it by means of a pin 82. The rod 80 extends through the tubular upright member 84 of a conventional cymbal support structure, which structure is only partially depicted in FIG. 5. The rod is attached at its upper end to the upper one 86 of a pair of conventional cymbals. The lower cymbal 88 is affixed to the tubular member 84.

The beater holder 32*a* of this apparatus can be pivoted into the striking position depicted at 32*a*′ by action of the remainder of the apparatus in exactly the same manner as the beater holder of the apparatus of the first embodiment described above can be pivoted into its striking position. When the beater holder is in striking position 32*a*′, the rod 80 and the upper cymbal 86 are displaced downwardly, so that the upper cymbal strikes the lower cymbal 88. Thus, the rod 80 and the upper cymbal serve as a beater for beating the lower cymbal 88. Of course, such a beater will emit a sound of its own upon striking.

Apparatus according to the present invention can be made in a variety of size and proportions. Merely by way of example, however, one successful apparatus in accordance with the first embodiment described above has been constructed in which the axle on which the pedal pivots is two inches above the bottom of the base, and the shaft to which the arm and beater are mounted is located twelve and three quarters inches forwardly of the axle and five and one half inches above the bottom of the base. In this apparatus, the arm extends one and one eighth inches from the shaft to the pin, and the links extend one and three fourths inches from pin to pin. The pedal extends eleven and one half inches from its juncture with the links to the axle.

Apparatus according to the present invention can be manufactured from conventional materials by the use of conventional techniques well known to those skilled in the art. However, each pivot point in the apparatus should be constructed with a minimum amount of clearance or slop. To minimize slop in the pivots, while also minimizing friction in the pivots, the use of commercially-available ball or roller bearings is preferred.

The foregoing description of the preferred embodiments should be understood as being merely illustrative of the present invention, as numerous variations and combinations of the features described above can be utilized without departing from the present invention, as defined in the appended claims.

What is claimed is:

1. A foot operable percussion instrument striking apparatus comprising a base, a pedal having a toe portion and a heel portion, said pedal being pivotally mounted at its heel portion to said base for movement about a generally horizontal pedal pivot axis generally perpendicular to the heel-to-toe axis of the pedal, such movement extending between an elevated position and a depressed position, a clip affixed to said pedal and overlying the toe portion of said pedal in spaced relation thereto so that said clip and the toe portion of said pedal cooperatively define a space adapted to receive the toe portion of an operator's foot placed upon said pedal, a beater holder movably mounted to said base for displacement into and out of a striking position, positive linkage means for moving said beater holder in response to movement of said pedal so that said beater holder is in said striking position when said pedal is in said depressed position or in said elevated position but said beater holder is out of said striking position when said pedal is in any position between said elevated and depressed positions, and means for operatively connecting a beater to said beater holder whereby, when a beater is so connected to said beater holder and a percussion instrument is juxtaposed with said apparatus so that such beater will contact such instrument when said beater holder is in said striking position, an operator may produce a sequence of beats by placing his foot upon said pedal and alternately depressing and lifting the toe of such foot in a pivoting motion about the ankle joint, said apparatus further comprising means for biasing the pedal to a neutral position between its elevated and depressed positions but closer to its elevated position than to its depressed position, said beater holder being moveable between said striking position, a fully-retracted position an an intermediate position between such positions, said linkage means being constructed and arranged so that said beater holder is in said intermediate position when said pedal is in said neutral position and said beater holder is in said fully-retracted position when said pedal is in a semi-depressed position between said neutral position and said depressed position.

2. Apparatus as claimed in claim 1, wherein said beater holder is pivotally mounted to said base, said linkage means includes an arm pivotally mounted to said base for movement about an arm axis parallel to said pedal pivot axis, said arm is operatively connected to said beater holder so that said arm and said beater holder pivot in unison, and said linkage means also includes a rigid link having an arm engaging end pivotally mounted to an end of said arm remote from said arm axis and a pedal engaging end pivotally mounted to the toe portion of said pedal.

3. Apparatus as claimed in claim 2, wherein said arm axis is at a greater elevation from said base than said pedal pivot axis, said arm axis is forward of the toe portion of said pedal, said arm is shorter than said link and said link is shorter than said pedal.

4. Apparatus as claimed in claim 3, wherein, when said pedal is in said neutral position, said arm extends generally downwardly from said arm axis, said link extends generally upwardly and rearwardly from said arm to said pedal, and said pedal extends generally forwardly and upwardly from its heel portion to its toe portion.

5. Apparatus as claimed in claim 2, wherein said linkage means includes an arm shaft rotatably mounted to said base at said arm axis and said beater holder and said arm are both affixed to said arm shaft.

6. Apparatus as claimed in claim 5 wherein said means for biasing includes a pedal spring affixed to said pedal and to said base, said pedal spring being arranged to urge said pedal upwardly, a spring arm extending from said arm shaft and a tension spring having one end affixed to said base and the other end affixed to the end of said spring arm remote from said arm shaft.

7. Apparatus as claimed in claim 1, further comprising a mallet-like drum beater affixed to said beater holder.

8. Apparatus as claimed in claim 1, further comprising a cymbal operatively connected to said beater holder for movement therewith.

* * * * *